US009329553B2

(12) United States Patent
Taniguchi

(10) Patent No.: US 9,329,553 B2
(45) Date of Patent: May 3, 2016

(54) SHEET CONVEYING DEVICE AND IMAGE FORMING APPARATUS

(71) Applicant: KYOCERA Document Solutions Inc., Osaka (JP)

(72) Inventor: Susumu Taniguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/815,166

(22) Filed: Jul. 31, 2015

(65) Prior Publication Data

US 2016/0033918 A1 Feb. 4, 2016

(30) Foreign Application Priority Data

Jul. 31, 2014 (JP) ..... 2014-155722

(51) Int. Cl.

| | |
|---|---|
| ***G03G 15/00*** | (2006.01) |
| ***B65H 7/02*** | (2006.01) |
| ***B65H 7/14*** | (2006.01) |
| ***B65H 7/06*** | (2006.01) |
| ***B65H 7/20*** | (2006.01) |
| ***B65H 5/06*** | (2006.01) |
| ***B65H 9/00*** | (2006.01) |
| *B65H 43/08* | (2006.01) |

(52) U.S. Cl.

CPC ..... *G03G 15/6529* (2013.01); *B65H 5/06* (2013.01); *B65H 7/02* (2013.01); *B65H 7/06* (2013.01); *B65H 7/20* (2013.01); *B65H 9/002* (2013.01); *B65H 7/14* (2013.01); *B65H 43/08* (2013.01); *B65H 2553/41* (2013.01); *B65H 2553/412* (2013.01)

(58) Field of Classification Search

CPC ..... B65H 2553/41; B65H 2553/412; B65H 2553/414; B65H 7/14; B65H 43/08

See application file for complete search history.

(56) References Cited

U.S. PATENT DOCUMENTS

| | | | | |
|---|---|---|---|---|
| 8,205,883 | B2 | 6/2012 | Fujita et al. | |
| 2005/0053390 | A1 * | 3/2005 | Suzuki | G01J 5/0022 399/69 |
| 2006/0071393 | A1 * | 4/2006 | Mizubata | B65H 1/04 271/10.01 |
| 2010/0044950 | A1 * | 2/2010 | Katsura | G03G 15/6579 271/10.03 |

FOREIGN PATENT DOCUMENTS

| | | |
|---|---|---|
| JP | 2008-195509 A | 8/2008 |
| JP | 2011-059460 A | 3/2011 |

* cited by examiner

*Primary Examiner* — Laura Martin
*Assistant Examiner* — John M Royston
(74) *Attorney, Agent, or Firm* — Studebaker & Brackett PC

(57) ABSTRACT

A sheet conveying device includes a sheet detecting sensor, a resist roller, a supporting member and a positioning member. The sheet detecting sensor is configured to detect a position of a sheet in a conveying path. The resist roller is configured to control a conveying timing of the sheet, based on a detection result by the sheet detecting sensor. The supporting member is configured to detachably support the sheet detecting sensor. The positioning member is configured to engage with the supporting member to position and fixedly attach the sheet detecting sensor, supported by the supporting member, at a normal position.

9 Claims, 6 Drawing Sheets

SHEET CONVEYING DEVICE AND IMAGE FORMING APPARATUS

INCORPORATION BY REFERENCE

This application is based on and claims the benefit of priority from Japanese Patent application No. 2014-155722 filed on Jul. 31, 2014, the entire contents of which are incorporated herein by reference.

BACKGROUND

The present disclosure relates to a sheet conveying device configured to convey a sheet to a predetermined position and an image forming apparatus including this sheet conveying device.

An image forming apparatus, such as a copying machine or a printer, is provided with a sheet conveying device configured to convey a sheet fed by a sheet feeding roller to an image forming part (photosensitive drum). The sheet conveying device has a resist roller which corrects an oblique conveying (skew) or the like of the sheet fed from the sheet feeding roller.

The sheet conveying device has also a resist sensor (hereinafter, referred to as a "sheet detecting sensor") at a position close to the resist roller. By the sheet detecting sensor, a position of the sheet in a conveying path is detected. In addition, on the basis of a detection result by this sheet detecting sensor, a conveying start timing of the sheet by the resist roller is controlled.

As described above, in the sheet conveying device, since the conveying start timing of the sheet by the resist roller is controlled on the basis of the detection result by the sheet detecting sensor, a positional relationship between the resist roller and the sheet detecting sensor becomes very important. Therefore, in a case where the sheet detecting sensor is replaced by reason such as a failure, it is necessary to precisely keep the positional relationship between the resist roller and the sheet detecting sensor.

However, in the sheet conveying device mentioned above, since it is general that the sheet detecting sensor is fixedly attached to a frame or the like by means of fastening member such as a screw, it is necessary to attach or detach the sheet detecting sensor by means of the fastening member such as a screw while carrying out a positioning adjustment work of the sheet detecting sensor every time the sheet detecting sensor is replaced. Accordingly, there is a problem that the attachment or detachment work and the positioning adjustment work of the sheet detecting sensor are very cumbersome.

SUMMARY

In accordance with an embodiment of the present disclosure, a sheet conveying device includes a sheet detecting sensor, a resist roller, a supporting member and a positioning member. The sheet detecting sensor is configured to detect a position of a sheet in a conveying path. The resist roller is configured to control a conveying timing of the sheet, based on a detection result by the sheet detecting sensor. The supporting member is configured to detachably support the sheet detecting sensor. The positioning member is configured to engage with the supporting member to position and fixedly attach the sheet detecting sensor, supported by the supporting member, at a normal position.

In accordance with an embodiment of the present disclosure, an image forming apparatus includes the sheet conveying device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, a sheet conveying device and an image forming apparatus according to an embodiment of the present disclosure will be described.

Figure 1:
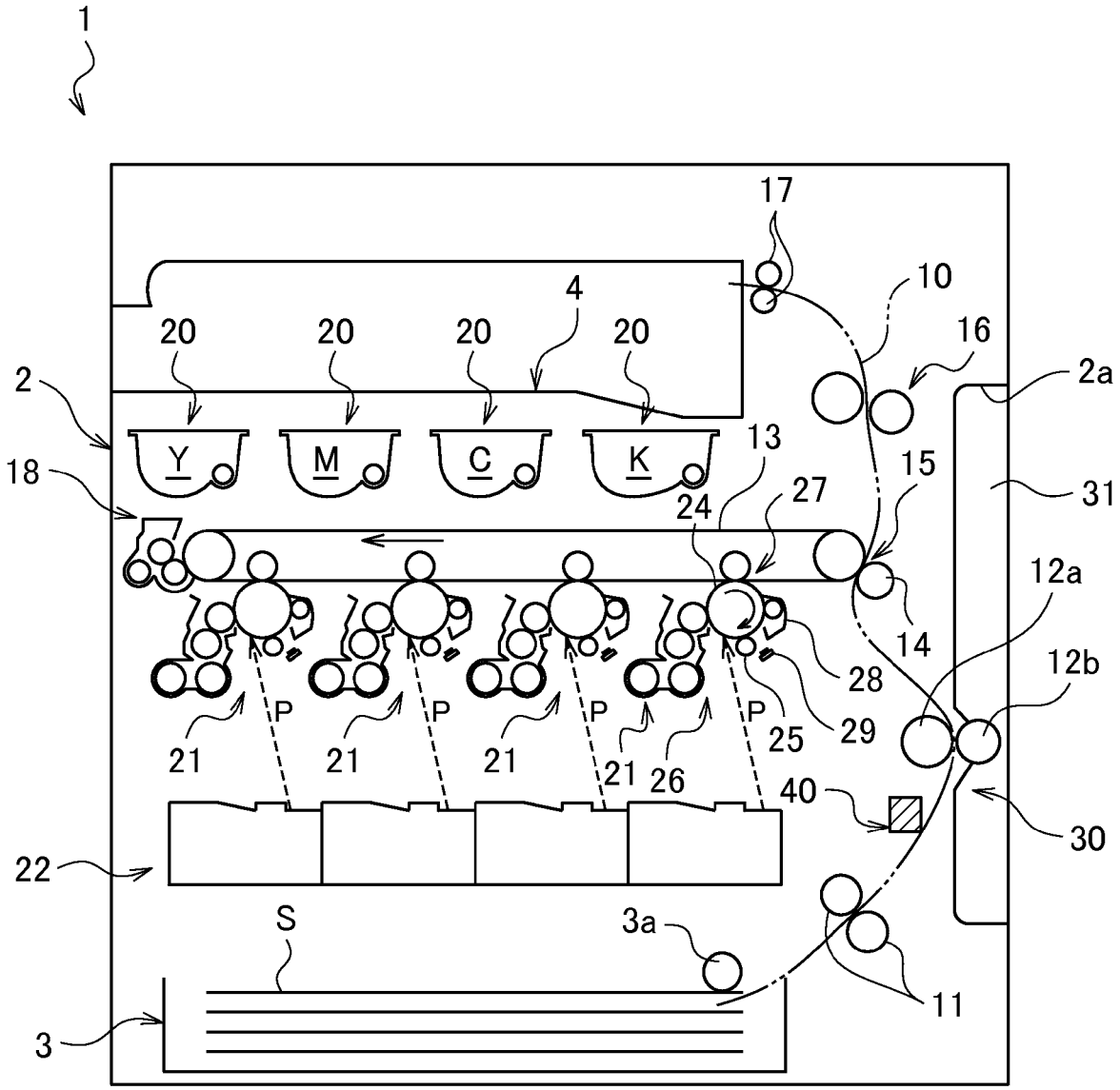
FIG. 1 is a schematic view showing an internal structure of a color printer including a sheet conveying device according to an embodiment of the present disclosure.

First, with reference to FIG. 1, the entire structure of a color printer 1 as an example of an electrographic image forming apparatus will be described. FIG. 1 is a schematic diagram schematically showing a color printer according to an embodiment of the present disclosure.

The color printer 1 is provided with a box-like formed apparatus main body 2, a sheet feeding cassette 3 arranged in a lower part of the apparatus main body 2 and an ejected sheet tray 4 formed on an upper face of the apparatus main body 2. The sheet feeding cassette 3 is configured to store a plurality of sheets S. A sheet feeding roller 3*a* comes in contact with the uppermost sheet S in the sheet feeding cassette 3. The sheet S stored in the sheet feeding cassette 3 includes not only a paper but a resin sheet, a OHP sheet and the like.

Inside the apparatus main body 2, a conveying path 10 of sheet S is formed so as to extend from the sheet feeding cassette 3 to the ejected sheet tray 4. Along the sheet conveying path 10, a pair of intermediate conveying rollers 11, 11, a pair of resist rollers 12*a*, 12*b*, a second transferring nip 15, a fixing device 16 and a pair of sheet ejecting rollers 17, 17 are arranged from the upstream side of the sheet conveying direction. The second transferring nip 15 is formed between the intermediate transferring belt 13 and a transferring roller 14.

On the downstream side from the pair of intermediate rollers 11, 11 in the sheet conveying direction, a sheet detecting sensor 40 is arranged at a position close to the pair of resist rollers 12*a*, 12*b* on the upstream side in the sheet conveying direction. The sheet detecting sensor 40, the pair of intermediate rollers 11, 11 and the pair of resist rollers 12*a*, 12*b*, mentioned above, forms a sheet conveying device 30. The sheet conveying device 30 will be described later in detail.

Inside the apparatus main body 2, an image forming part 18 is provided. The image forming part 18 includes four drum units 21 and an exposure device 22 containing a laser scanning unit (LSU) and is configured to form an image using four-color (magenta, cyan, yellow and black) toner (developer) stored in respective toner containers 20.

The four drum units 21 are arranged under the intermediate belt 13 side by side. Each drum unit 21 has the same structure containing a photosensitive drum 24 as an image carrier, a charger 25, a development unit 26, a first transferring roller 27, a cleaning device 28 and a static eliminator 29. The photosensitive drum 24 is rotatably supported. Around the photosensitive drum 24, the charger 25, the development unit 26, the first transferring roller 27, the cleaning device 28 and the static eliminator 29 are arranged in the order of first transferring process.

Next, the operation of forming an image by the color printer 1 having such a configuration will be described.

When a print start instruction is inputted to the color printer 1, the exposure device 22 exposes (refer to the dotted arrow in FIG. 1) the surface of the photosensitive drum 24, which is electrically charged into a predetermined voltage, in accordance to the image data to form an electrostatic latent image on the surface of the photosensitive drum 24. The electrostatic latent image is then developed into a toner image using the toner supplied from the toner containers 20. On the intermediate transferring belt 13, a first transferred toner image of each color is carried by the first transferring roller 27 applied with a first transferring bias voltage.

On the other hand, when a sheet S fed from the sheet feeding cassette 3 by the sheet feeding roller 3*a* into the sheet conveying path 10 is detected by the sheet detecting sensor 40, based on the detection signal outputted from the sheet detecting sensor 40, the pair of resist rollers 12*a*, 12*b* are operated to convey the sheet S toward the second transferring nip 15.

At the second transferring nip 15, the toner image having full color is transferred onto the sheet S by applying the second transferring bias voltage. In the fixing device 16, the toner image is fixed on the sheet S. The sheet S after passing the fixing device 16 is ejected to the ejected sheet tray 4. Toner and excess electric charge remained on the photosensitive drum 24 after the transferring are eliminated by the cleaning device 28 and static eliminator 29, respectively.

Figure 2:
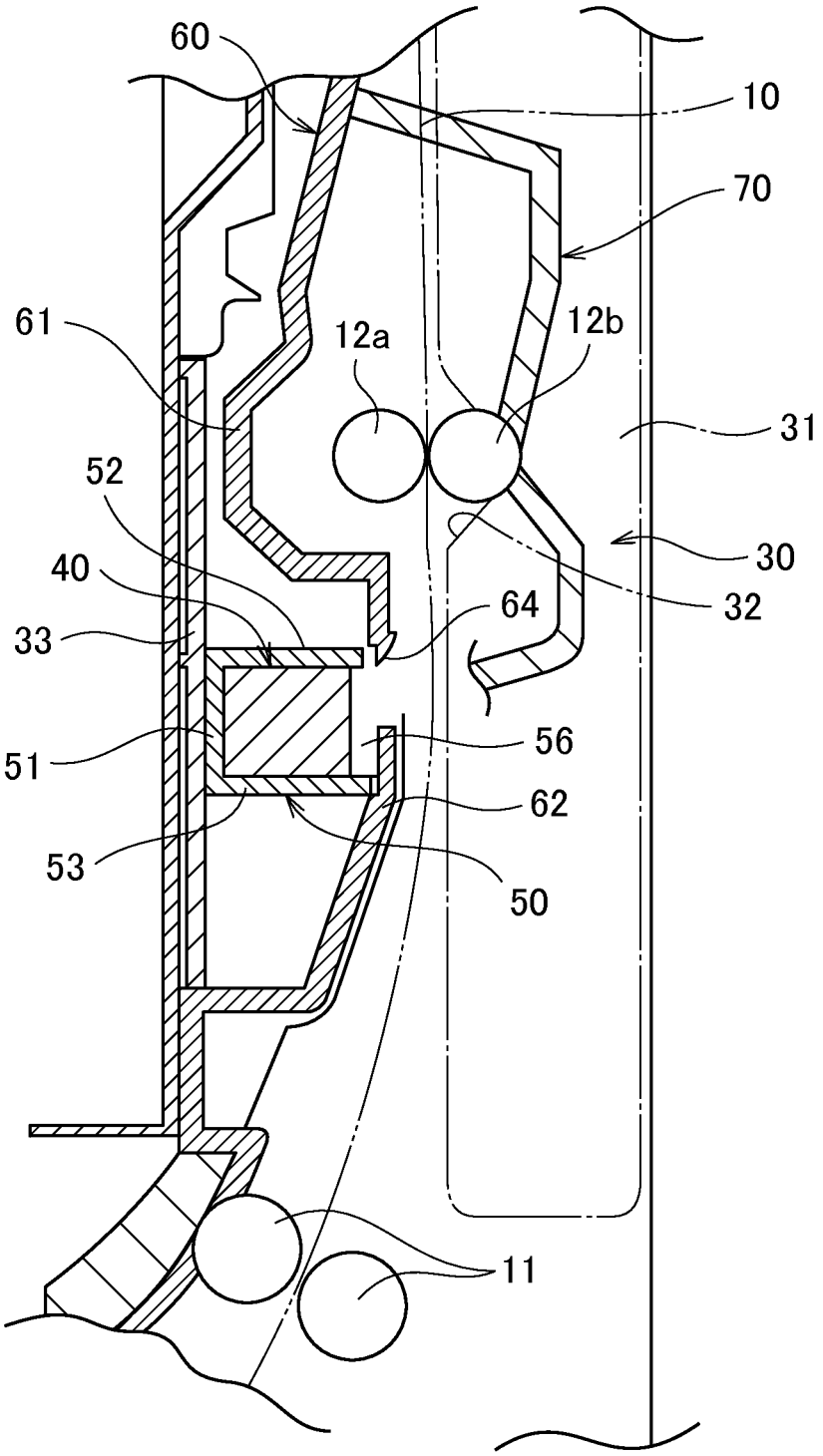
FIG. 2 is a sectional view showing a main structure of the sheet conveying device according to the embodiment of the present disclosure.
Figure 3:
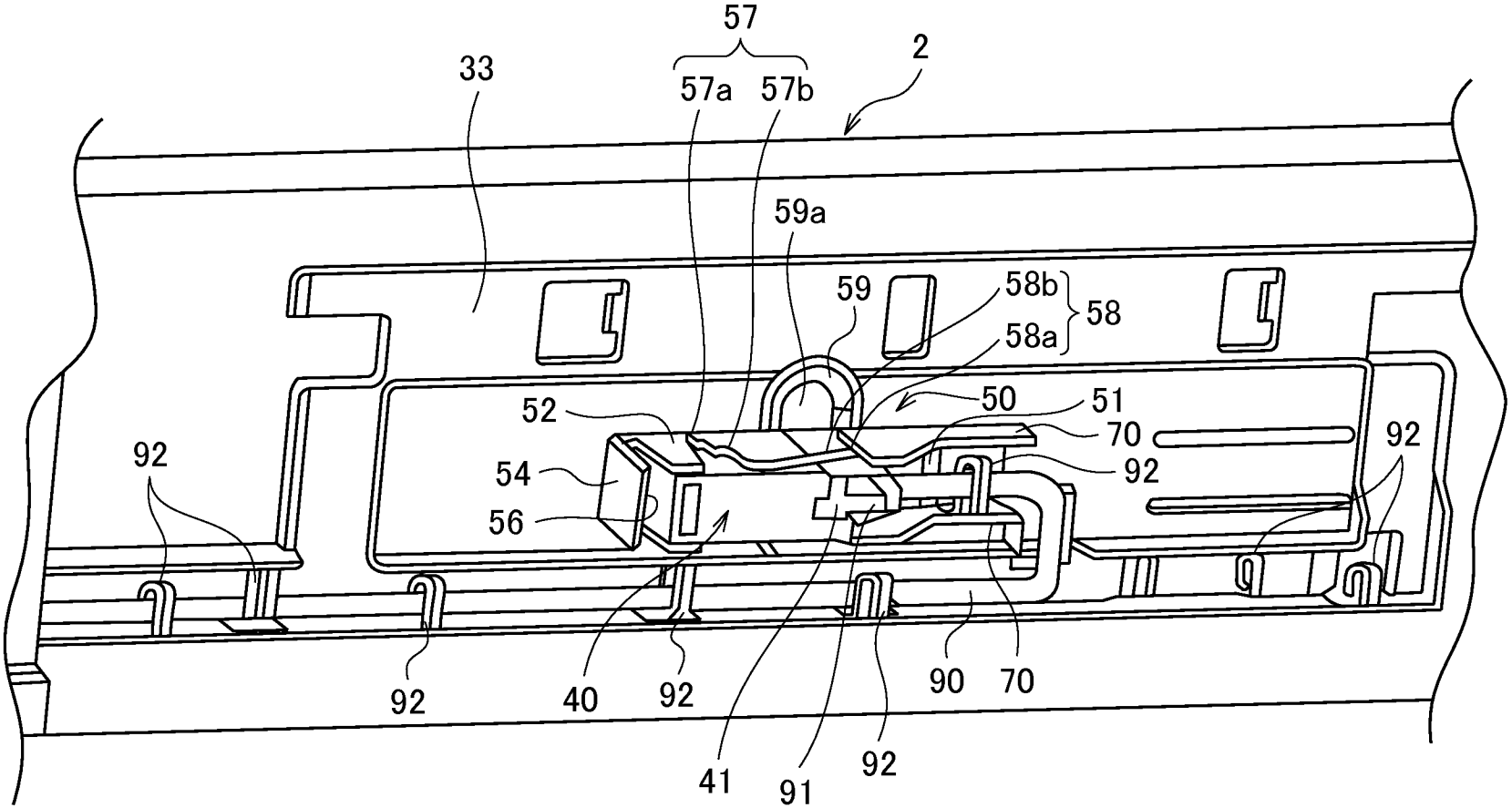
FIG. 3 is a perspective view showing the main structure in which a cover member is removed, in the sheet conveying device according to the embodiment of the present disclosure.
Figure 4:
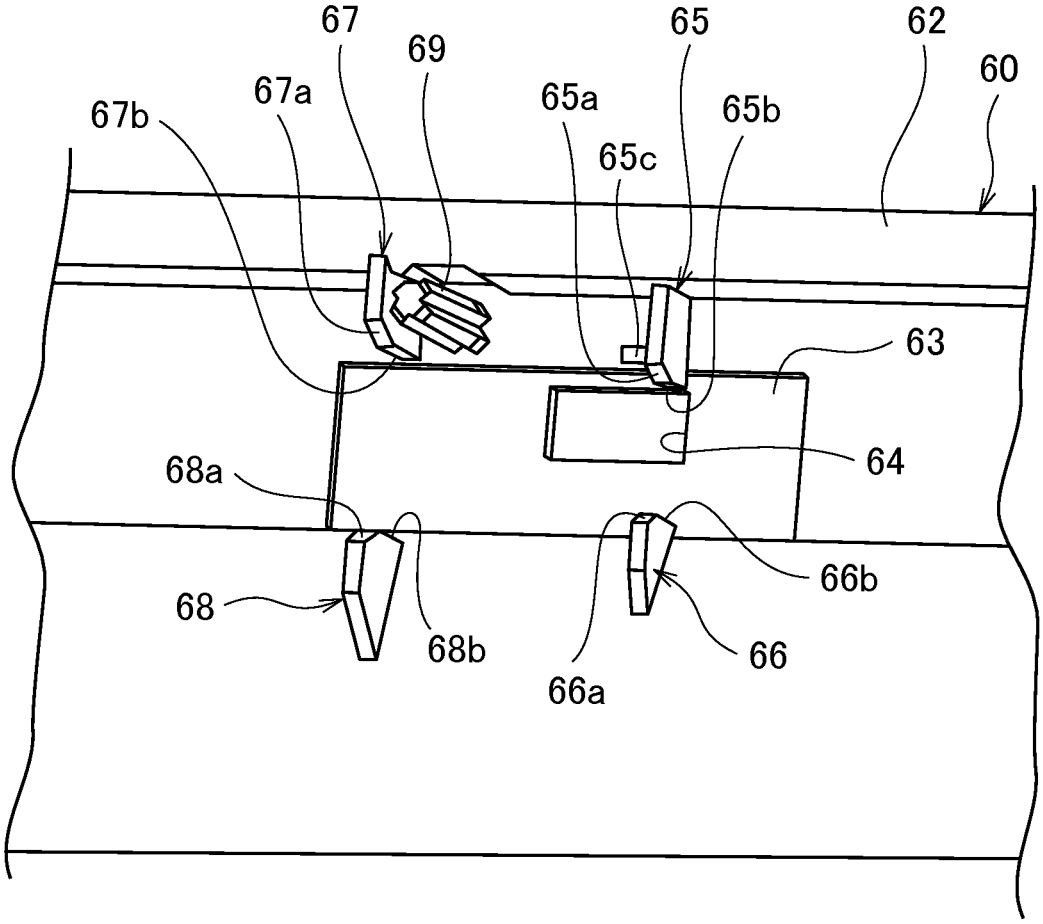
FIG. 4 is a perspective view showing a back side face of the cover member of the sheet conveying device according to the embodiment of the present disclosure.

Next, with reference to FIGS. 2 to 4, the sheet conveying device 30 will be described in detail. FIG. 2 is a sectional view showing a main structure of the sheet conveying device 30, FIG. 3 is a perspective view showing the main structure in which a cover member 60 is detached, in the sheet conveying device 30, and FIG. 4 is a perspective view showing aback side face of the cover member 60 of the sheet conveying device 30.

As described above, the sheet conveying device 30 is provided with the pair of intermediate conveying rollers 11, 11, the pair of resist rollers 12*a*, 12*b* and the sheet detecting sensor 40. One resist roller 12*a* of the pair of resist rollers 12*a*, 12*b* is composed of a metallic roller and the other resist roller 12*b* is composed of an elastic rubber-based roller.

The other resist roller 12*b* is supported in a housing recessed part 32 of an auxiliary conveying cover 31 which is provided on one side face of the apparatus main body 2 (right side face of FIG. 2). The auxiliary conveying cover 31 is turnable between a closed position in a vertical posture and an open position in an inclined posture around its lower end.

The sheet detecting sensor 40 is a reflection-type optical sensor (photo interrupter sensor) having a substantially rectangular solid shape, and has: an emitting unit (not shown) to emit light to the sheet S on the conveying path 10; and a light receiving unit (not shown) to receive the light reflected from the sheet S. On one side face (right face of FIG. 3) in the length direction of the sheet detecting sensor 40, a female connector 41 is attached. The sheet detecting sensor 40 is detachably attached to a supporting member 50 in a horizontal posture with the female connector 41 direct toward the one side.

The supporting member 50 has a substantially U-shaped cross section, and is fixedly attached to a frame plate 33 attached in a substantially vertical posture inside of the apparatus main body 2. The supporting member 50 has: a bottom plate 51 formed along the frame plate 33; a upper face supporting plate 52 and a lower face supporting plate 53, both of which have elasticity and extend so as to oppose to each other in one direction (right direction of FIG. 2) from upper and lower ends of the bottom plate 51; and a side face plate 54 extending to the one direction from the other side (left side of FIG. 3) of the bottom plate 51. The one side (right side of FIG. 3) of the supporting member 50 is opened.

Between the upper face supporting plate 52 and the lower face supporting plate 53, a supporting space having a dimension capable of loosely engaging the sheet detecting sensor 40 is formed. Opposing to the bottom face plate 51, an opening 56 is formed, through which the sheet detecting sensor 40 can be passed at the time of attachment and detachment of the sheet detecting sensor 40 to and from the supporting space.

At tip ends of the upper face supporting plate 52 and the lower face supporting plate 53 in the one direction, an engaging claw part 55 (refer to FIG. 5 and FIG. 6) is respectively formed protruding in the supporting space. The engaging claw part 55 is arrowhead-shaped and has a guiding face 55*a*. The both guiding faces 55*a* are inclined so as to be close each other toward the supporting space.

As shown in FIG. 3, at the tip ends of the upper face supporting plate 52 and the lower face supporting plate 53, a first notch 57 and a second notch 58 are respectively formed in order from the other side. The first notch 57 has: a slit portion 57*a* formed straightly from the tip end to the bottom plate 51; and a stepped portion 57*b* formed so as to spread from around a center of the slit portion 57*a* toward the second notch 58. The second notch 58 has: a slit portion 58*a* formed straightly from the tip end toward the bottom plate 51; and an inclined portion 58*b* formed to be inclined from around a center of the slit portion 58*a* toward the first notch 57. Also, the one side portions of the upper face supporting plate 52 and the lower face supporting plate 53 are significantly cut out into a short piece part 70.

Above a center portion of the upper face supporting plate 52, a substantially semicircular engaging hole 59*a* is formed on the frame plate 33, and around the engaging hole 59*a*, a guiding face 59 is formed so as to be inclined toward the engaging hole 59*a*.

The female connector 41 of the sheet detecting sensor 40 is electrically connectable to a male connector 91 attached to a terminal end of a cable 90 (refer to FIG. 3). The cable 90 is wired so as to pass through the opening formed on the one side of the supporting member 50 outward, be bent downward and folded to an opposite direction. The cable 90 is supported by a plurality of fixtures 92 disposed along the one side of the supporting member 50 and a lower edge of the frame plate 33.

On the frame plate 33, a cover member 60 is fixedly attached by means of a plurality of fastening screws (not shown) so as to cover the opening 56 of the supporting member 50. As is well shown in FIG. 2, the cover member 60 is formed in a substantially archery shape having a recessed part 61 and a protruding part 62. Outside of the recessed part 61, one resist roller 12*a* of the pair of resist rollers 12*a*, 12*b* is supported rotatably around a supporting shaft (not shown), and inside of the protruding part 62, the supporting member 50 in which the sheet detecting sensor 40 is housed is supported. Also, on an inner face (back face side) of the protruding part 62, a rectangular supporting recessed part 63 (refer to FIG. 4) is formed. The supporting recessed part 63 is formed with a through hole 64 through which the light emitting unit (not shown) of the sheet detecting sensor 40 is exposed.

As shown in FIG. 4, on the upper and lower sides of the supporting recessed part 63, a first pair of upper engaging protruding part 65 and lower engaging protruding part 66 and a second pair of upper engaging protruding part 67 and lower engaging protruding part 68 are respectively protruded as a positioning member. The first upper engaging protruding part 65 is formed in a substantially rectangular plate shape so as to be able to engage with the slit portion 57*a* of the first notch 57 of the upper face supporting plate 52, and has: an engaging inclined portion 65*a* at a lower corner; and an engaging flat face portion 65*b* on a lower end face. Also, the first upper engaging protruding part 65 is formed with a projection part 65*c* extending from a lower portion of the side face toward the upper second engaging protruding part 67. The projection part 65*c* is configured to be capable of engaging with the stepped portion 57*b* of the first notch 57 of the upper face supporting plate 52. On the other hand, the first lower engaging protruding part 66 is formed in a substantially triangular plate shape so as to be able to engage with the slit portion 57*a* of the first notch 57 of the lower face supporting plate 53, and has: an engaging inclined portion 66*a* at an upper corner; and an engaging flat face portion 66*b* on an upper end face.

The second upper engaging protruding part 67 is formed in a substantially rectangular plate shape so as to be able to engage with the slit portion 58*a* of the second notch 58 of the upper face supporting plate 52, and has: an engaging inclined portion 67*a* at a lower corner; and an engaging flat face portion 67*b* on a lower end face. Also, at a position close to the first engaging protruding part 65 from the second upper engaging protruding part 67, a positioning boss 69 having a sectional cross shape is protruded. This positioning boss 69 is capable of engaging with an engaging hole 59 of the flame 33. On the other hand, the second lower engaging protruding part 68 is formed in a substantially triangular plate shape so as to be able to engage with the slit portion 58*a* of the second notch 58 of the lower face supporting plate 53, and has: an engaging inclined portion 68*a* at an upper corner; and an engaging flat face portion 68*b* at an upper end face.

Figure 5:
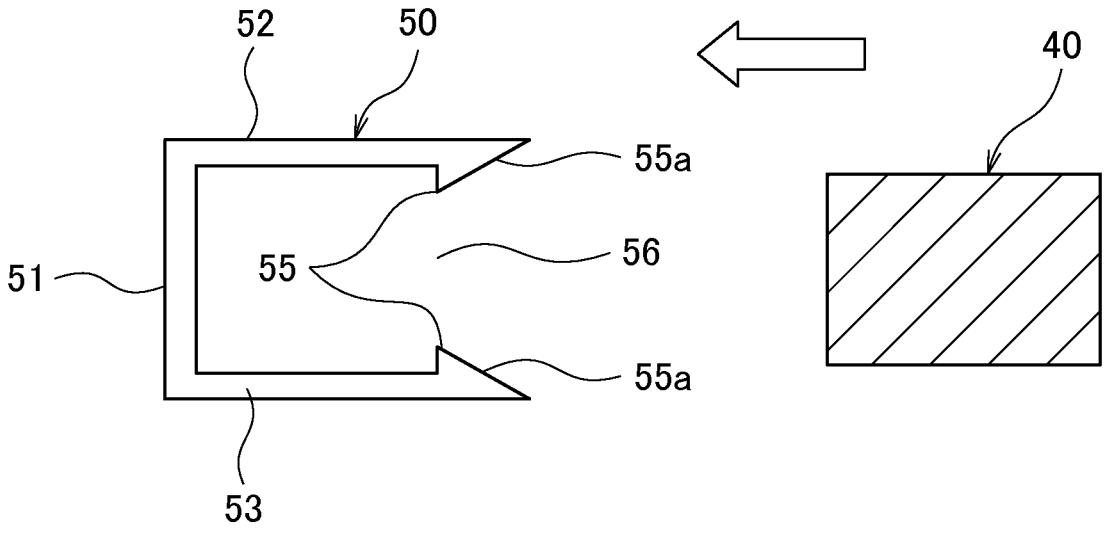
FIG. 5 is a sectional view schematically showing a supporting member to which a sheet detecting sensor is not supported, in the sheet conveying device according to the embodiment of the present disclosure.

Next, in addition to FIGS. 2 to 4, with reference to FIGS. 5 to 6, a procedure for attaching and detaching the sheet detecting sensor 40 to or from the supporting member 50 will be described. FIG. 5 is a sectional view schematically showing the supporting member 50 before the attachment of the sheet detecting sensor 40, and FIG. 6 is a sectional view schematically showing the supporting member 50 to which the sheet detecting sensor 40 is supported.

Keeping the sheet detecting sensor 40 in the horizontal posture with the female connector 41 directing to the one side, as indicated by the arrow in FIG. 5, when the sheet detecting sensor 40 is pushed into the supporting member 50 through the opening 56 of the supporting member 50, corners of the sheet detecting sensor 40 abut against the guiding faces 55*a* of the respective engaging claw parts 55 of the upper face supporting plate 52 and the lower face supporting plate 53, whereby the upper face supporting plate 52 and the lower face supporting plate 53 are elastically deformed in the vertical direction to be spaced away from each other.

Figure 6:
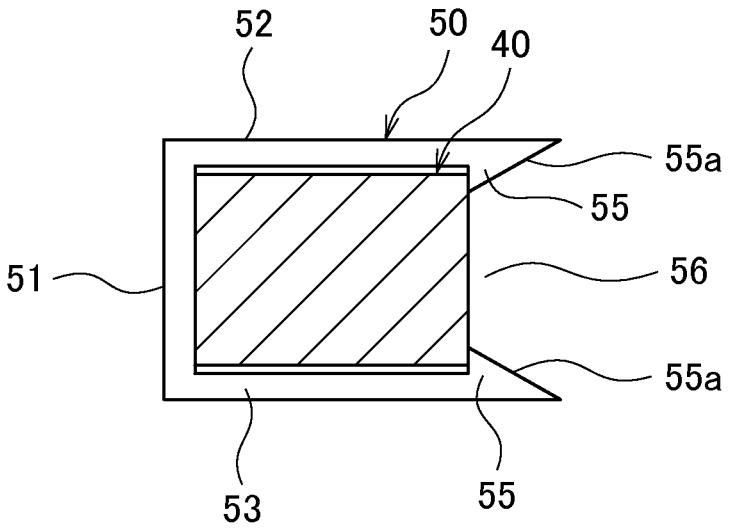
FIG. 6 is a sectional view schematically showing the supporting member to which the sheet detecting sensor is supported, in the sheet conveying device according to the embodiment of the present disclosure.

If the sheet detecting sensor 40 is further pushed into the supporting member 50, as shown in FIG. 6, the sheet detecting sensor 40 is housed in the supporting member 50. The upper face supporting plate 52 and the lower face supporting plate 53 are returned into their original postures by their elasticity and then the respective engaging claw parts 55 are engagingly locked with the sheet detecting sensor 40. In this manner, the sheet detecting sensor 40 is supported at a temporary position in the horizontal posture with the female connector 41 directing to the one side in the supporting space of the supporting member 50. In addition, in this state, to the female connector 41 of the sheet detecting sensor 40, a male connector 91 of the cable 90 that is supported in advance to the frame plate 33 by the fixture 92 is connected.

Next, to the sheet detecting sensor 40 thus supported by the supporting member 50, the supporting recessed part 63 of the cover member 60 is opposed. Then, by engaging the positioning boss 69 with the engaging hole 59 of the frame plate 33, the cover member 60 is positioned and fixedly attached to the frame plate 33.

At this time, the engaging inclined portions 65*a*, 66*a* of the first upper and lower engaging protruding parts 65, 66 are guided by the sheet detecting sensor 40 and then engaged with the slit portions 57*a* of the first notches 57, and the projection part 65*c* is engaged with the stepped portion 57*b* of the first notch 57. Also, the engaging inclined portions 67*a*, 68*a* of the second upper and lower engaging protruding parts 67, 68 are guided by the sheet detecting sensor 40 and then engaged with the slit portions 58*a* of the second notches 58. In this manner, the engaging flat plate portions 65*b*, 66*b* of the first upper and lower engaging protruding parts 65, 66 and the engaging flat plate portions 67*b*, 68*b* of the second upper and lower engaging protruding parts 67, 68 respectively abut against the upper face and the bottom face of the sheet detecting sensor 40 supported at the temporary position in the horizontal posture by the supporting member 50, whereby the sheet detecting sensor 40 moves from the temporary position in the supporting space in the vertical direction, performing the vertical positioning of the sheet detecting sensor 40. In addition, at this time, the other end face of the sheet detecting sensor 40 abuts against the side face plate 54, whereby the sheet detecting sensor 40 is positioned in the horizontal direction. As mentioned above, after temporarily supporting the sheet detecting sensor 40 by the supporting member 50, the cover member 60 is attached to the frame plate 33, whereby the sheet detecting sensor 40 can be fixedly attached at a normal position in the supporting space.

On the other hand, in a case where the sheet detecting sensor 40 is detached, after the cover member 60 is detached from the frame plate 33, the upper face supporting plate 52 and the lower face supporting plate 53 are elastically deformed in the vertical direction to be spaced from each other, and then the sheet detecting sensor 40 is pulled out from the supporting member 50 to thereby detach the sheet detecting sensor 40.

Thus, with the sheet conveying device 30 according to the embodiment described above, the work of attaching and detaching the sheet detecting device 40 can be easily carried out without a need to use a tool or the like. In addition, at the time of replacement of the sheet detecting sensor 40, there is no need to carry out wiring processing of the cable 90 again, and it is sufficient if only the sheet detecting sensor 40 is replaced. Further, since the cover member 60 which supports the resist roller 12*a* is configured to carry out the positioning of the sheet detecting sensor 40, a positional relationship between the pair of resist rollers 12*a*, 12*b* and the sheet detecting sensor 40 can be determined by one member, making it possible to prevent an occurrence of distortion in assembling due to a cumulative tolerance between members interposed between the resist rollers 12*a*, 12*b* and the sheet detecting sensor 40; and therefore, the resist rollers 12*a*, 12*b* and the sheet detecting sensor 40 can be precisely positioned each other.

Incidentally, although the sheet conveying device 30 according to the embodiment described above is structured so that the first pair of upper and lower engaging protruding parts 65, 66 and the second pair of upper and lower engaging protruding parts 67, 68 protruded in the cover member 60 abut against the top and bottom faces of the sheet detecting sensor 40 supported in the horizontal posture at the temporary position in the supporting member 50 to thereby carry out the vertical positioning, the present disclosure is not limited thereto. That is, the engaging protruding part provided in the cover member 60 is configured to abut against an end face or a corner as well as the top and bottom faces of the sheet detecting sensor 40, and by the engaging protruding part, it is also possible to simultaneously carry out the horizontal positioning as well as the vertical positioning of the sheet detecting sensor 40.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A sheet conveying device comprising:

a sheet detecting sensor configured to detect a position of a sheet in a conveying path;

a resist roller configured to control a conveying timing of the sheet, based on a detection result by the sheet detecting sensor;

a supporting member configured to detachably support the sheet detecting sensor; and a positioning member configured to engage with the supporting member to position and fixedly attach the sheet detecting sensor, supported by the supporting member, at a normal position;

wherein the supporting member includes:

a pair of supporting plates formed to oppose to each other so as to form a supporting space of the sheet detecting sensor and including a plurality of notches;

an opening through which the sheet detecting sensor passes when the sheet detecting sensor is attached and detached to and from the supporting space, and a cover member configured to cover the opening, wherein the positioning member is formed on the cover member and has an engaging protruding part formed to engage with the notch so as to abut against the sheet detecting sensor supported in the supporting space.

2. The sheet conveying device according to claim 1, wherein the resist roller is supported by the cover member.

3. The sheet conveying device according to claim 1, wherein the pair of supporting plates are formed with claw part configured to prevent slippage of the sheet detecting sensor from the opening.

4. The sheet conveying device according to claim 1, wherein the sheet detecting sensor is connected to a cable via a connector in the supporting space, and the cable is supported by a plurality of fixtures.

5. An image forming apparatus comprising the sheet conveying device according to claim 1.

6. A sheet conveying device comprising:

a sheet detecting sensor configured to detect a position of a sheet in a conveying path;

a resist roller configured to control a conveying timing of the sheet, based on a detection result by the sheet detecting sensor;

a supporting member configured to detachably support the sheet detecting sensor; and a positioning member configured to engage with the supporting member to position and fixedly attach the sheet detecting sensor, supported by the supporting member, at a normal position;

wherein the supporting member includes:

a pair of supporting plates formed to oppose to each other so as to form a supporting space of the sheet detecting sensor;

an opening through which the sheet detecting sensor passes when the sheet detecting sensor is attached and detached to and from the supporting space, and a cover member configured to cover the opening, wherein the positioning member is formed on the cover member, the supporting member is fixedly attached, to a frame plate and has an engaging hole, and the cover member is formed with a positioning boss configured to engage with the engaging hole so as to be positioned with respect to the frame plate.

7. The sheet conveying device according to claim 6, wherein the resist roller is supported by the cover member.

8. The sheet conveying device according to claim 6, wherein the sheet detecting sensor is connected to a cable via a connector in the supporting space, and the cable is supported by a plurality of fixtures.

9. An image forming apparatus comprising the sheet conveying device according to claim 6.

* * * * *